United States Patent [19]

Kingsford

[11] 3,998,235

[45] Dec. 21, 1976

[54] ADJUSTABLE MASCARA APPLICATOR

[75] Inventor: Ted I. Kingsford, Memphis, Tenn.

[73] Assignee: Plough, Inc., Memphis, Tenn.

[22] Filed: Nov. 24, 1975

[21] Appl. No.: 634,703

[52] U.S. Cl. ..... 132/88.5; 132/88.7; 401/128

[51] Int. Cl.[2] ..... A45D 40/30

[58] Field of Search ..... 132/88.5, 88.7, 141–142, 132/139, 144, 124, 120, 85, 79, 150, 76.5; 15/183, 186; 401/128, 18, 183, 122, 186; 74/62

[56] References Cited

UNITED STATES PATENTS

| | | | |
|---|---|---|---|
| 2,141,327 | 12/1938 | Younghusband | 132/85 |
| 3,756,731 | 9/1973 | Aubry | 401/122 |
| 3,892,248 | 7/1975 | Kingsford | 132/88.7 |

*Primary Examiner*—G.E. McNeill

*Attorney, Agent, or Firm*—Vincent H. Gifford; Bruce M. Eisen; Stephen B. Coan

[57] ABSTRACT

An applicator for applying a predetermined metered amount of a cosmetic material characterized by a plurality of axially spaced coating surfaces in which the axial distance between each coating surface is adjustable.

19 Claims, 14 Drawing Figures

ADJUSTABLE MASCARA APPLICATOR

This invention relates to an improved device for applying a predetermined metered amount of cosmetic. More particularly, the invention relates to a mascara applicator in which the quantity of mascara which is retained by the applicator head is predetermined and the distance between at least two of the adjacent coating surfaces is adjustable.

During recent years eye makeup has received increased emphasis and numerous applicators have been designed to apply mascaras which curl, color and lengthen the eyelashes. Certain of the applicators also aid in combing and separating the lashes so that the mascara is more uniformly distributed on the hairs. Examples of the various types of applicators are shown in U.S. Pat. Nos. 2,141,327 (Youngiiusband); 2,829,655 (Bau); 3,033,213 (Joss et al); 3,214,782 (Masters et al); 3,343,551 (Anderson); 3,363,635 (Wurmbock); 3,690,777 (Costa); 3,756,731 (Aubry); 3,862,639 (Schefer et al); 3,892,248 (Kingsford); and 3,896,823 (Spatz).

In most mascara applicators, as evidenced by the references listed above, the applicator member is disposed in a mascara mass within a container. The excess mascara is removed by an elastic wiper as the applicator is withdrawn from the container. A metered amount of cosmetic remains between the threads, brush hair or comb teeth for application to the eyelashes. In any given applicator, essentially the same metered quantity of mascara is retained for any individual application for all users regardless of the length, thickness or density of the individuals' lashes, and without regard as to whether the upper or lower lashes are to be treated.

In accordance with the present invention, it will now be possible for the mascara user to retain on the applicator the quantity of mascara suited for both her upper and lower lashes. A user can therefore, at her discretion, apply either a heavy or thin coating of mascara by merely selecting the volume of mascara which is to be dispensed by the applicator with a simple selection of the distance between the coating surfaces. A user with skimpy, sparsely distributed lashes will no longer be burdened with the mess associated with an excessive quantity of mascara, and a user with full dense lashes will now be able to uniformly coat her lashes more rapidly without the need for constantly recoating the applicator. It will also be possible for the user to select the quantity of mascara suited to her lower lashes which are invariably shorter and less dense than the upper lashes.

As a mascara applicator, the present invention has the additional advantage of allowing the mascara user to enhance the lash appearance by selection of the spacing which will optimize the combing and separating action of the applicator. For example, a user with thin, sparse lashes, who desired a light or touch-up coat of mascara, could compress the applicator head prior to removal from the container. After removal from the container, she could extend the applicator head to control the degree of combing and separating suited to her lashes.

Accordingly, it is an object of the present invention to provide a mascara applicator which will enable the user to select the amount of mascara which is to be applied.

It is a further object to provide a mascara applicator which will hold the amount of mascara suited for both the upper and lower lashes of any individual user.

It is a further object to provide a mascara applicator in which the combing and separating action can be adjusted to suit all users regardless of lash thickness, length or density.

It is a further object to provide an applicator which will hold a proper amount of a pasty, semi-liquid or liquid product in which a predetermined metered amount of the product is to be dispensed.

Figure 1:
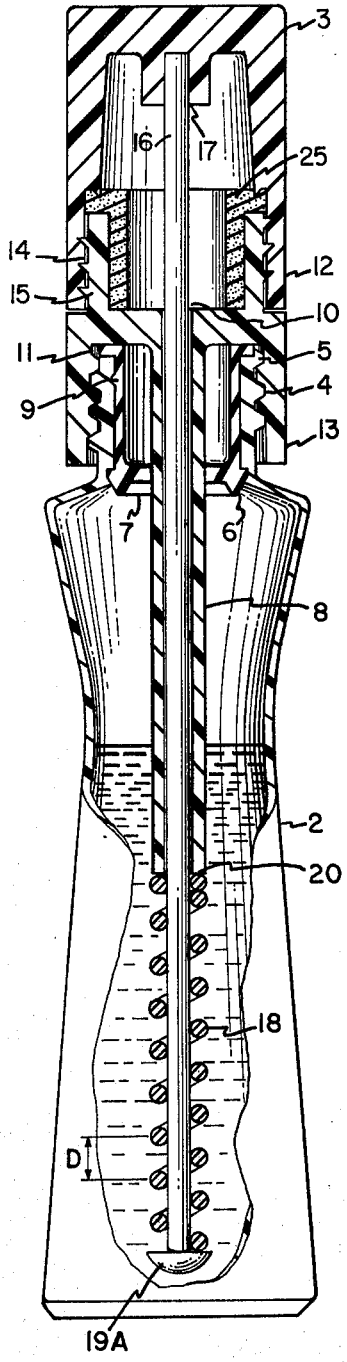
FIG. 1 is a longitudinal sectional view of an adjustable helical compression spring applicator within its associated container.
Figure 2:
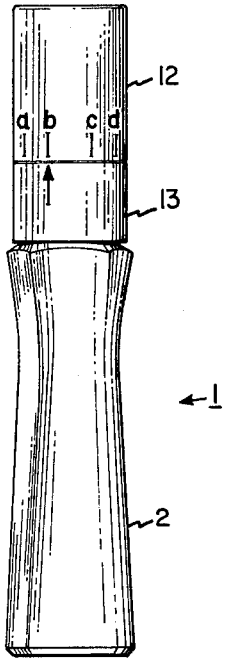
FIG. 2 is a longitudinal view of a fully assembled mascara container.

Referring to FIGS. 1 and 2 there is illustrated an eyelash cosmetic applicator or dispenser 1 that consists of a container or tubular reservoir 2 and a cap 3. The cap 3 is provided with internal threads 4 which mesh with the external threads 5 of bottle 2.

Inserted within the mouth of the container is a wiper 6. The wiper has a central aperture 7 that is adapted to seal against the outer surface of applicator shaft 8. The wiper is retained in the neck of the bottle by bead 9, which mates with a corresponding groove in the bottle neck, and a lip 11 that extends above the neck of the bottle. The lip 11 further acts as a seal between the cap and the bottle upon closure of the bottle. In the preferred embodiment the wiper is made of neoprene rubber or a similar material which would afford resistance to the dispensed material.

The cap is attached to the mascara applicator and serves as a handle for holding the applicator. The cap consists of upper first cap portion 12 and lower second cap portion 13. The two portions are operatively connected by the internal threads 14 of the first portion and the external threads 15 of the second portion for reasons to be more apparent hereafter. An adjusting rod 16 is slidingly disposed within the central aperture 10 of shaft 8, which is integral with the second cap portion 13, and is fixedly attached at its upper end to groove 17 in the first cap portion 12. Seal 25 prevents leakage of any mascara which may have worked its way through the central aperture of shaft 8.

The mascara applicator 18 surrounds the lower portion of the adjusting rod 16 and is held in place at its lower end by a flanged tip 19A, and at its upper end by the base 20 of shaft 8. It would, of course, be possible to attach the applicator to either tip 19A, base 20 or both to prevent the wiper from compressing the applicator during insertion or withdrawal from the container.

Figure 3:
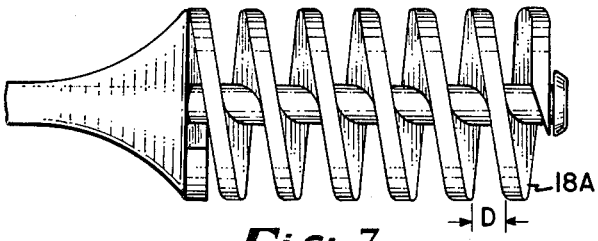
FIG. 3 is an enlarged perspective view of the preferred embodiment in which the applicator head is in the form of a flat spiral spring.

The preferred embodiment of the mascara applicator as shown in FIGS. 1 and 3 is a helical spring with the distance between adjacent spirals or coating surfaces being indicated by the letter "D" in FIGS. 1 and 3. The distance D between at least two of the surfaces is adjustable through a tension adjusting means. In FIG. 1 this is primarily accomplished by threads 14 and 15. As the first cap portion 12 is removably rotated with respect to the second cap portion 13, the adjusting rod which is fixedly secured at groove 17 moves axially. The helical spring applicator 18 is compressed between the shaft base 20 and the rod tip 19A and the distance D between the adjustable coating surfaces is reduced. The degree of compression can be selected, for example, by alignment of one of the calibration lines *a-d* located on the upper cap portion 12 with an arrow located on lower cap portion 13 as shown in FIG. 2.

FIG. 3 shows the preferred embodiment in which a flat spring 18A is used as the coating surface. In the preferred embodiment, the edge of the spring is flat although a tapered edge is also possible.

Figure 4:
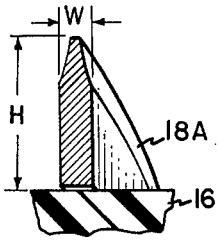
FIG. 4 is an enlarged partial sectional through a tapered version of the flat spring of FIG. 3.

FIG. 4 is a partial sectional through a tapered version of the flat spring 18A of FIG. 3. The preferred ratio of the height (H) to the width (W) of the flat spring is generally about 4, with the preferred range of the ratio generally being from 1 to 8.

Figure 5:
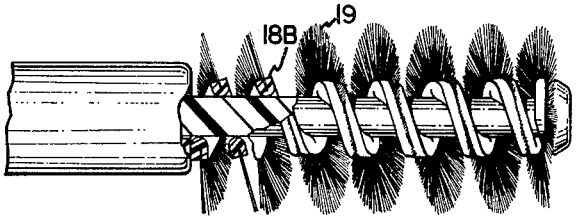
FIG. 5 is an enlarged partial sectional perspective view of an embodiment in which the applicator head is in the form of a helical brush.

FIG. 5 shows an embodiment in which a helical spring 18B with attached bristles 19 is used as the coating surface. The bristles can be either uniformly distributed around the entire spring periphery or attached at only certain predetermined points, such as on alternate turns of the coil or along one or more longitudinally positioned portions along the applicator axis. Bristles could, of course, be attached to any of the disclosed embodiments or equivalents thereof.

Figure 6:
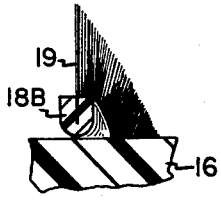
FIG. 6 is an enlarged partial sectional view of the helical brush of FIG. 5.

FIG. 6 is a partial cross-sectional view of the helical brush of FIG. 5. In the embodiment shown the bristles 19 are locked in place between two folded over faces of the spring material. Other means of attaching the bristles will readily occur to one skilled in the art.

Figure 7:
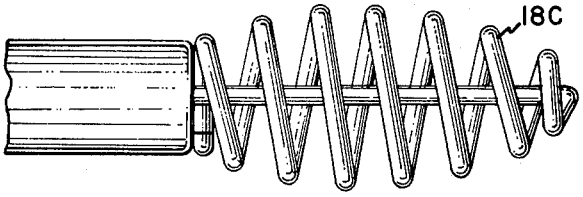
FIG. 7 is an enlarged perspective view of an embodiment in which the applicator head is tapered.

FIG. 7 shows an embodiment in which the helical spring applicator 18C is tapered to facilitate application of mascara to the smaller lash hairs at either side of an eye. It is, of course, understood that any of the embodiments disclosed herein or equivalents thereof could be similarly tapered. FIG. 7 also shows an embodiment in which the adjusting rod 16 and applicator 18C are integrally formed from a single section of spring material.

Figure 8:
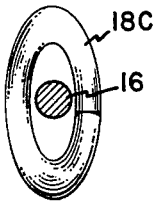
FIG. 8 is an enlarged cross-sectional end view of one of the turns of the FIG. 7 applicator.

FIG. 8 shows a cross-sectional view of one of the turns of the FIG. 7 applicator in an oval or elliptical shape such as shown in U.S. Pat. No. 3,896,823. It is, of course, understood that any of the embodiments disclosed herein could also be made into an oval or any other appropriate shape.

Figure 9:
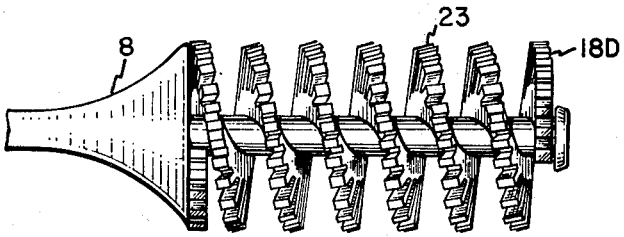
FIG. 9 is an enlarged perspective view of an embodiment in which the applicator head is in the form of a flat serrated spring.

FIG. 9 shows an embodiment in which the helical spring applicator 18D is serrated as at 23 and is reduced dimensionally along central shaft 8 to afford better visibility to the user.

Figure 10:
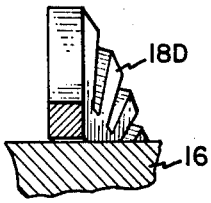
FIG. 10 is an enlarged partial sectional view of the serrated spring applicator of FIG. 9.

FIG. 10 shows a section of the serrated spring applicator of FIG. 9. It would, of course, be possible to make the serrations in any shape or depth.

Figure 11:
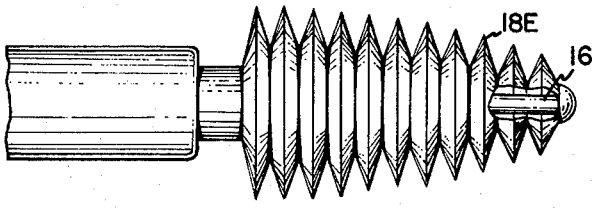
FIG. 11 is an enlarged perspective partial sectional view of an embodiment in which the applicator head is in the form of a bellows.

FIG. 11 shows an embodiment in which the coating surface 18E is in the form of a plurality of circumferential grooves in a bellows configuration. In the embodiment shown, the adjusting rod 16 extends through the center of the bellows. This arrangement is most convenient when a helical coating surface is undesirable, although it could, of course, also be used for a helical surface.

Figure 12:
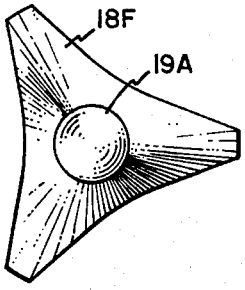
FIG. 12 is an enlarged end view of a three tined applicator.

FIG. 12 is an enlarged end view of a three tined applicator 18F such as shown in U.S. Pat. No. 3,892,248. The three tined embodiment is one of the variations of the serrated applicator as shown in FIG. 9, although it could also be easily incorporated into the bellows construction of FIG. 11. In an embodiment with two or more rows of tines, it would be possible to provide adjustability for some or all of the rows. For example, in a two or three tined applicator, it would be possible to provide adjustability between the coating surfaces of only one of the rows of tines.

Figure 13:
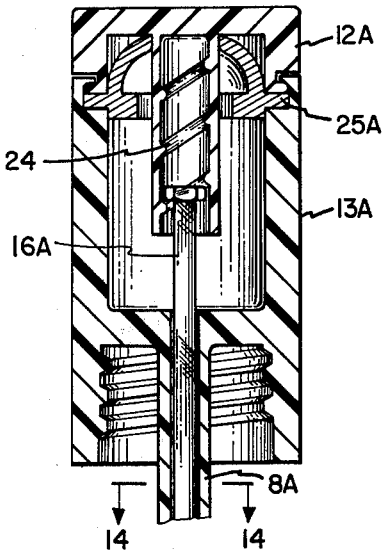
FIG. 13 is an enlarged partial cross-sectional view of another embodiment of the tension adjusting means associated with the cap of FIG. 1.

FIG. 13 shows an alternate embodiment for a tension adjusting means in the cap 3. In this embodiment the adjusting rod 16A is movable axially along bead 24 by rotating the first cap portion 12A relative to the second cap portion 13A. Seal 25A prevents leakage of any mascara which may have worked its way through the central aperture of shaft 8A. Although both FIGS. 1 and 13 shows portions 12 and 13 rotationally mounted with respect to one another, other operative relationships will occur to one skilled in the art, such as slidably mounted in the axial direction.

Figure 14:
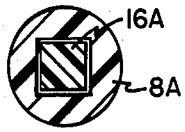
FIG. 14 is an enlarged cross-sectional along the lines 14—14 of FIG. 13.

FIG. 14 shows a cross-sectional view of the shaft 8A and rod 16A of FIG. 13. The inside diameter of the shaft and the outside diameter of the rod are shown to be rectangular to prevent rotational movement between them, although any out of round shape could be used.

As is apparent a helical spring applicator is preferred since the spacing can be conveniently adjusted by a simple compression of the spring without the need for additional compression means between each coating surface. Many convenient spring materials will suggest themselves such as aluminum, steel or plastic.

It is also apparent that the applicator disclosed herein can be used in a variety of applications other than for mascara. For example, it could be used to apply coloring to an eyebrow, moustache, beard or hair upon the head, or to apply a metered amount of any pasty, liquid or semi-liquid product which was a cosmetic, medicament or otherwise.

In applications of certain fluid or semi-fluid products it might be desirable to treat or roughen the coating surface in order to improve product retention. For example, the surface could be textured by sand blasting, or the surface could be flocked by adhesively attaching fibers to it.

The range of possible distances between the coating surfaces would, of course, depend upon the purpose for which the applicator was being used. It has, however, been found that for mascara the distance can generally range between 0 and 3.2 mm. The zero setting (e.g. full compression) could be used for touchup, separating lashes or lower lash application. In a mascara applicator, it would generally be desirable to adjust the distances between all of the coating surfaces, although it would be possible to provide for adjustability between only selected portions of the applicator head.

In the preferred embodiment of a mascara applicator, the design parameters generally preferred are as follows. The applicator head has an overall diameter of 3–10 mm, and an overall length of 5–35 mm. The total number of tines or thread revolutions is generally from 5 to 15 with each individual tine or thread having an axial thickness of 0.3 to 1.0 mm, and a radial depth of 1.0 to 3.0 mm. The thickness can, however, be tapered down to about 0.1 mm. In the helical embodiment a left handed thread (opposite to that shown in FIG. 1) is preferred since it is best suited for right handed users.

While several embodiments have been shown to illustrate the invention, it will be understood by those skilled in the art that various changes and modifications can be made without departing from the scope of the invention.

I claim:

1. An eyelash cosmetic applicator comprising:
a. a shaft,
b. handle means attached to one end of said shaft,
c. a helical spring applicator head aligned with the axis of said shaft and encircling the other end of said shaft, and
d. means for setting the axial distance of adjacent turns of said spring between 0–3.2 mm.

2. An applicator as in claim 1 wherein said helical spring has a left handed thread.

3. An eyelash cosmetic applicator comprising:
a. a shaft,
b. handle means attached to one end of said shaft,
c. an applicator head comprising a plurality of coating surfaces axially spaced along said shaft, and
d. means for adjusting the axial spacing between adjacent coating surfaces to optimize the combing and separating action of the applicator and the amount of mascara that is applied to the lashes.

4. An applicator for pasty, liquid or semi-liquid products comprising:
a. a shaft,
b. handle means attached to one end of said shaft,
c. an applicator head comprising a plurality of coating surfaces axially spaced along said shaft, and
d. means for adjusting the axial spacing between at least two adjacent coating surfaces.

5. An applicator as in claim 4 wherein said applicator head is a helical spring.

6. An applicator as in claim 5 wherein the external surface of said helical spring is serrated.

7. An applicator as in claim 5 wherein the sides of said helical spring are flat.

8. An applicator as in claim 7 wherein said sides are tapered radially outwardly.

9. An applicator as in claim 5 wherein at least a portion of the external surface of said helical spring contains bristles.

10. An applicator as in claim 4 wherein said applicator head comprises a plurality of axially aligned tines.

11. An applicator as in claim 10 wherein said tines are in the form of a bellows.

12. An applicator as in claim 4 wherein the means for adjusting the axial spacing is integrally associated with said handle means.

13. An applicator as in claim 4 wherein said handle means comprises a first and second portion, said first portion being operatively associated with said shaft and said second portion being operatively associated with said applicator head, whereby movement of said first portion relative to said second portion comprises said adjusting means.

14. An eyelash cosmetic package comprising:
a. a bottle,
b. a mascara like composition partially filling said bottle,
c. a bottle closure,
d. an applicator as in claim 4 attached to said bottle closure and adapted to be immersed in said cosmetic when said bottle closure is attached to said bottle, and
e. wiper means within said bottle and positioned intermediate said applicator head and said bottle closure when said closure is attached to said bottle, said wiper adapted to clear excess cosmetic from said applicator head.

15. An eyelash cosmetic package as in claim 14 wherein said handle means and said means for adjusting the axial spacing are integrally associated with said bottle closure.

16. An eyelash cosmetic package as in claim 14 wherein said bottle closure comprises a first and second portion, rotatably mounted with respect to one another, said first portion being operatively associated with said shaft and said second portion being operatively associated with said applicator head, whereby rotation of said first portion relative to said second portion comprises said adjusting means.

17. An applicator as in claim 4 wherein said adjusting means sets the distance between adjacent coating surfaces in the range of 0–3.2 mm.

18. An applicator as in claim 4 wherein said coating surface is textured.

19. An applicator as in claim 4 wherein said coating surface is flocked with minute fibers.

* * * * *